US008166705B2

(12) United States Patent
Iimori et al.

(10) Patent No.: US 8,166,705 B2
(45) Date of Patent: May 1, 2012

(54) SUPPORT STRUCTURE FOR VEHICULAR RESIN WINDOW

(75) Inventors: Yasushi Iimori, Aichi (JP); Kenji Yamamoto, Kanagawa (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 262 days.

(21) Appl. No.: 12/605,615

(22) Filed: Oct. 26, 2009

(65) Prior Publication Data

US 2010/0107504 A1 May 6, 2010

(30) Foreign Application Priority Data

Oct. 27, 2008 (JP) ..... 2008-275674

(51) Int. Cl.
*E05F 11/34* (2006.01)

(52) U.S. Cl. ..... 49/362; 49/349

(58) Field of Classification Search ..... 49/348, 49/349, 502, 362
See application file for complete search history.

(56) References Cited

U.S. PATENT DOCUMENTS 3,324,594 A * 6/1967 Hettinger et al. ..... 49/28
4,788,795 A * 12/1988 Pinsonneault ..... 49/352
4,920,697 A * 5/1990 Vail et al. ..... 49/348
5,035,083 A * 7/1991 Kruzich ..... 49/352
6,631,586 B1 * 10/2003 Nakagomi et al. ..... 49/349
6,708,448 B2 * 3/2004 Zappa ..... 49/41

FOREIGN PATENT DOCUMENTS

DE 19703720 7/1998
JP 60-150291 10/1985

OTHER PUBLICATIONS

Partial English language translation of JP 60-150291, Oct. 5, 1985.
English language Abstract of DE 19703720, Jul. 23, 1998.

* cited by examiner

*Primary Examiner* — Jerry Redman
(74) *Attorney, Agent, or Firm* — Greenblum & Bernstein, P.L.C.

(57) ABSTRACT

A resin window includes a plate-shaped main body portion and a gear projection portion that is molded integrally with the main body portion so as to project in a thickness direction of the main body portion from a rear end portion of the main body portion. A part of a side face of the gear projection portion is surrounded by a gear-side guide frame for guiding the raising/lowering of the resin window. The gear projection portion includes a meshing gear provided along a vertical direction to mesh with a drive gear, and positioning members provided respectively on upper and lower end portions of the gear projection portion to abut on an inside surface of the gear-side guide frame. When the drive gear is rotated, the positioning members slide relative to the inside surface of the gear-side guide frame, and thus the resin window can be raised or lowered along the gear-side guide frame.

8 Claims, 8 Drawing Sheets

SUPPORT STRUCTURE FOR VEHICULAR RESIN WINDOW

BACKGROUND OF THE INVENTION

1. Field of the Invention

The present invention relates to a support structure for a vehicular resin window, which supports a resin window of a vehicle so that the resin window can be raised and lowered.

2. Description of the Related Art

A support structure that supports a vehicle window made of glass, or the like, so that the vehicle window can be raised and lowered is known in the related art.

For example, a rack member made of resin or the like and including a meshing gear which meshes with a drive gear that can be rotated by rotating means is attached to a side end portion of a window. When the rotating means rotates the drive gear, the window can be raised and lowered along a guide frame via the rack member.

Japanese Utility Model Application Laid Open No. 60-150291, for example, which is cited here as Patent Document 1, discloses a window support structure in which a resin rack member is attached to one or both of the side end portions of a window.

However, this conventional structure has the following problems.

When the rack members are provided in both side end portions of the window, deviation in the mesh phases of the two meshing gears from each other may be caused, leading to problems in the raising/lowering of the window. Furthermore, an increase of the number of constructional components is caused, leading to problems in terms of cost, weight, space, and so on.

On the other hand, when the rack member is provided only on one side end portion of the window and the window is made of a material of low rigidity, the other side portion in which the rack member is not provided may easily become dislodged from the guide frame. Furthermore, when the window tilts due to its own weight, raising/lowering resistance, external loads, and so on, a load may be concentrated on the guide frame on the side of the window where the rack member is provided, also leading to problems in the raising/lowering of the window.

SUMMARY OF THE INVENTION

The present invention has been designed in consideration of the above problems in the related art, and it is an object thereof to provide a support structure for a vehicular resin window in which a resin window can be supported sufficiently and securely using a simple structure and the resin window can be raised and lowered smoothly and precisely.

The present invention is a support structure for a vehicular resin window, the structure being configured to support a resin window of a vehicle so that the resin window can be raised and lowered, wherein the resin window includes: a plate-shaped main body portion and a gear projection portion that is molded integrally with the main body portion so as to project in a thickness direction of the main body portion from one side end portion of the main body portion. At least a part of the side face of the gear projection portion is surrounded by a gear-side guide frame for guiding the raising/lowering of the resin window. Further, the gear projection portion includes a meshing gear provided along a vertical direction to mesh with a drive gear that can be rotated by rotating means, and positioning members provided respectively on at least upper and lower end portions of the gear projection portion to abut on an inside surface of the gear-side guide frame. When the drive gear is rotated by the rotating means in the support structure for a vehicular resin window, the positioning members slide relative to the inside surface of the gear-side guide frame such that the resin window is raised or lowered along the gear-side guide frame.

DESCRIPTION OF THE PREFERRED EMBODIMENTS

Embodiments of a support structure for a vehicular resin window according to the present invention will now be described below.

First Embodiment

Figure 1:
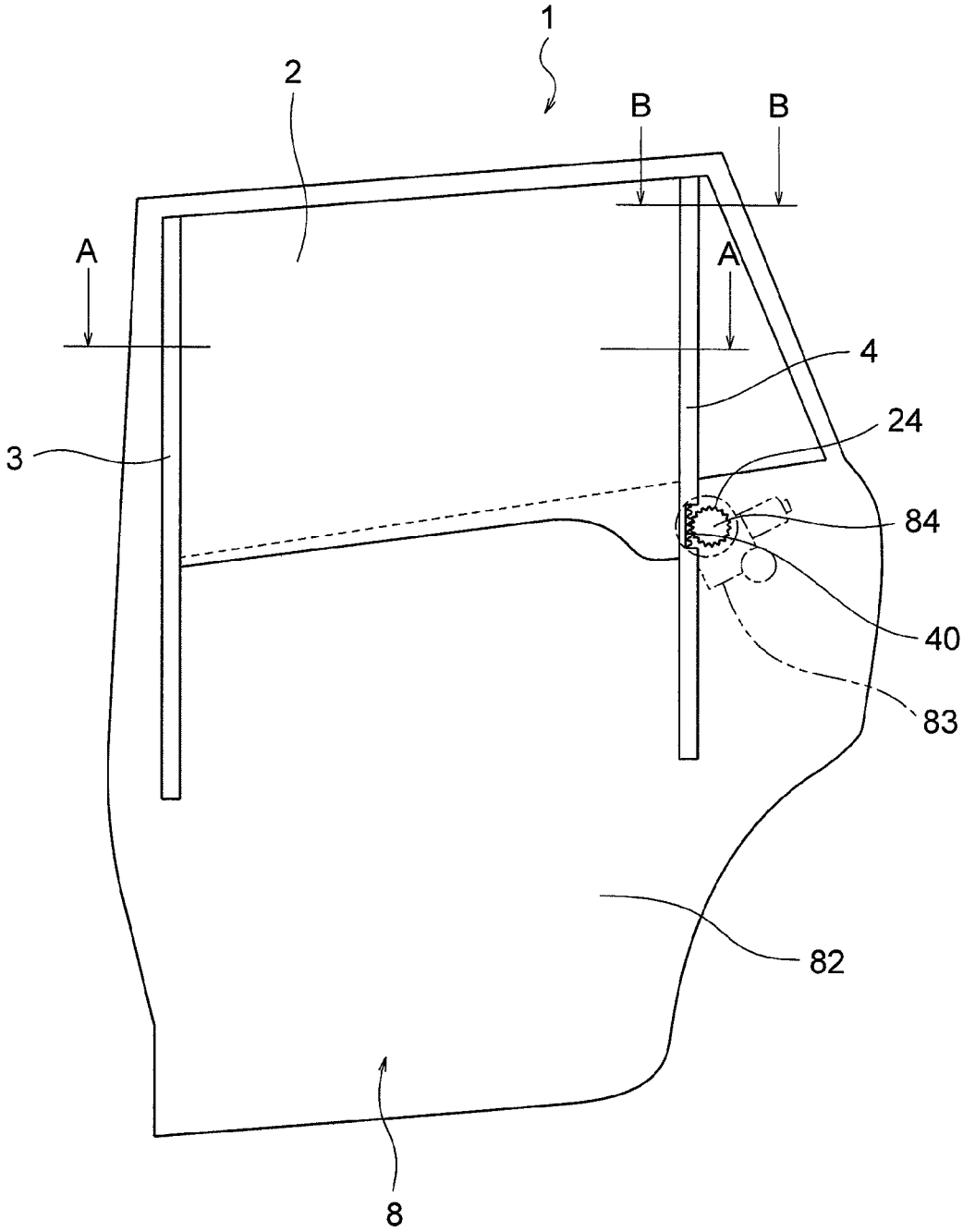
FIG. 1 is an illustrative view showing a support structure for a resin window according to a first embodiment.

As shown in FIG. 1, this embodiment relates to a support structure 1 in a vehicle lateral door 8 which supports a resin window 2 so that the resin window 2 can be raised and lowered.

Here, terms expressing directions and positions such as "front-rear", "upper-lower", "inner-outer", and so on, denote directions and positions in a state where the resin window 2 is attached to the door 8.

As shown in FIGS. 1 to 5, in the support structure 1 of this embodiment, the resin window 2 has a main body portion 21 of a quadrangular plate-shape and a gear projection portion 23 that is molded integrally with the main body portion 21 on one side end portion of the main body portion 21 so as to project in a thickness direction of the main body portion 21.

A side face of the gear projection portion 23 is partially surrounded by a gear-side guide frame 4 for guiding the raising/lowering of the resin window 2.

As shown in FIGS. 1 to 5, a meshing gear 24 which meshes with a drive gear 84 that can be rotated by a motor (rotating means) 83 is provided on the gear projection portion 23 along a vertical direction, and positioning members 25 that abut on an inside surface of the gear-side guide frame 4 are provided respectively in upper and lower end portions of the gear projection portion 23. In other words, the positioning members 25 are provided respectively in the portions including the vicinity of the upper end portion and the lower end portion of the gear projection portion 23.

When the motor 83 rotates the drive gear 84, the positioning members 25 are made to slide relative to the inside surface of the gear-side guide frame 4, and thus the resin window 2 can be raised and lowered along the gear-side guide frame 4.

The above construction will now be described in detail.

As shown in FIG. 1, the vehicle door 8 is constituted by an inner panel (not shown) and an outer panel 82. An other-side guide frame 3 is disposed on a front end portion of the outer panel 82, and the gear-side guide frame 4 is disposed on a rear end portion. The other-side guide frame 3 and the gear-side guide frame 4 are provided along the vertical direction in parallel to each other. Further, the resin window 2 is inserted between the other-side guide frame 3 and the gear-side guide frame 4. In other words, the resin window 2 is disposed along the front-rear direction of the vehicle.

Further, as shown in FIG. 1, the motor 83 and the drive gear 84 that is rotated by the motor 83 are disposed on the rear side of the gear-side guide frame 4. An opening 40 is formed on the gear-side guide frame 4 near the drive gear 84, and a part of the inserted resin window 2 is exposed from the opening 40.

Figure 2:
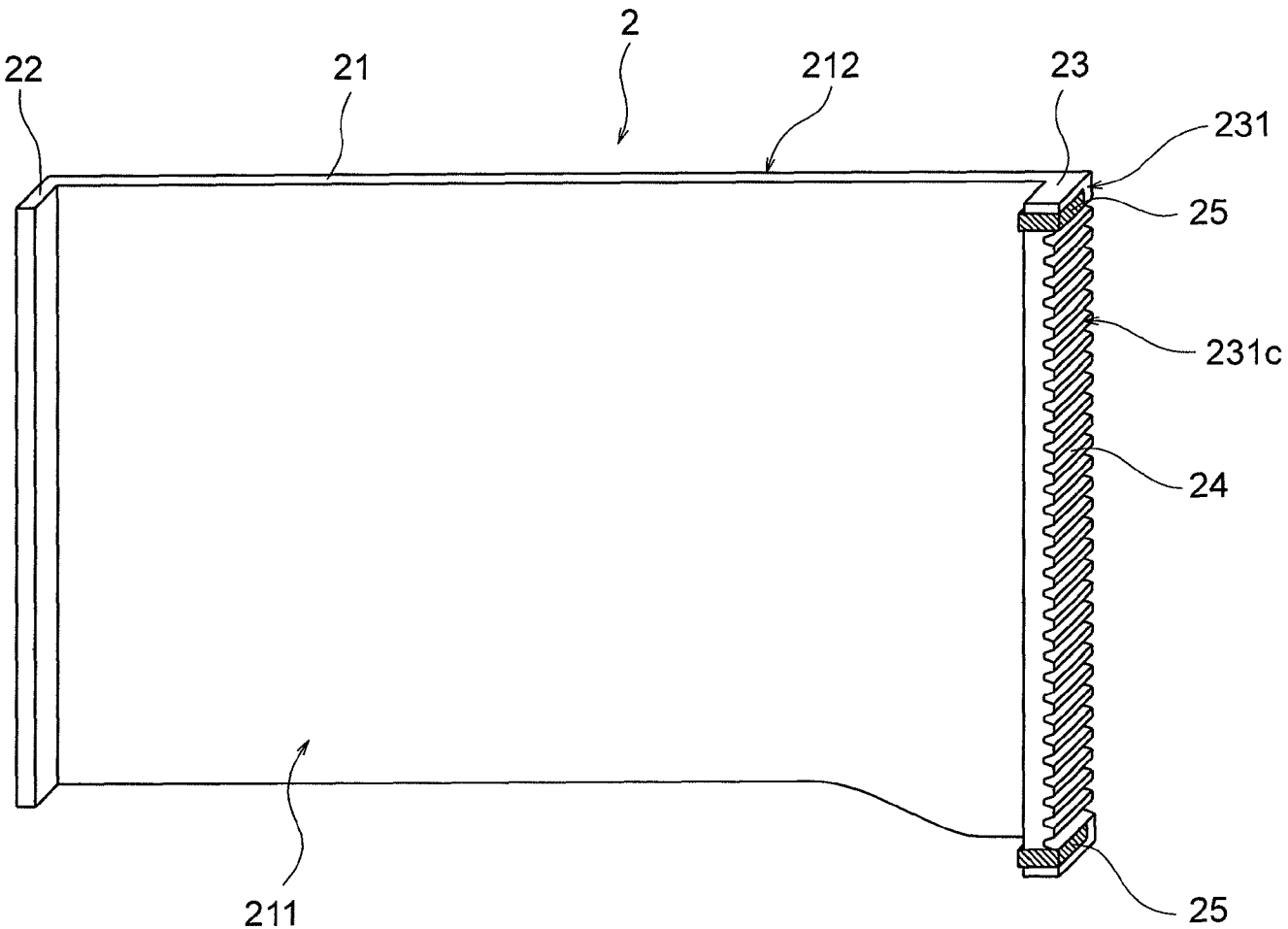
FIG. 2 is a perspective view showing the entire resin window according to the first embodiment.

As shown in FIG. 2, the resin window 2 is constituted by the plate-shaped main body portion 21 as well as an other projection portion 22 and the gear projection portion 23, which are respectively disposed in the front end portion and rear end portion of the main body portion 21 so as to project from an inner surface 211 of the main body portion 21 toward the vehicle-interior-side. The main body portion 21, other projection portion 22, and gear projection portion 23 are integrally molded into the resin window 2 which has a C-shaped horizontal cross-section. In addition, the resin window 2 according to this embodiment is made of polycarbonate resin.

Further, as shown in FIG. 2, the meshing gear 24 that meshes with the drive gear 84 is provided along the vertical direction on a rear side surface (a rear-side outer side surface 231*c*, to be described below) of the outer side surface 231 of the gear projection portion 23. In this embodiment, as shown in FIG. 1, the meshing gear 24 meshes with the drive gear 84 in the opening 40 of the gear-side guide frame 4.

Further, the positioning members 25 that abut on the inside surface (an inner side surface 411 of a frame portion 41, to be described below) of the gear-side guide frame 4 are provided in the upper end portion and lower end portion of the gear projection portion 23. The positioning members 25 have a large horizontal dimension so as to project further outward than the other parts of the gear projection portion 23 where the positioning members 25 are not provided. Furthermore, the positioning members 25 are molded integrally with the gear projection portion 23. Here, in this embodiment, shoe members are employed as the positioning members 25.

Figure 3:
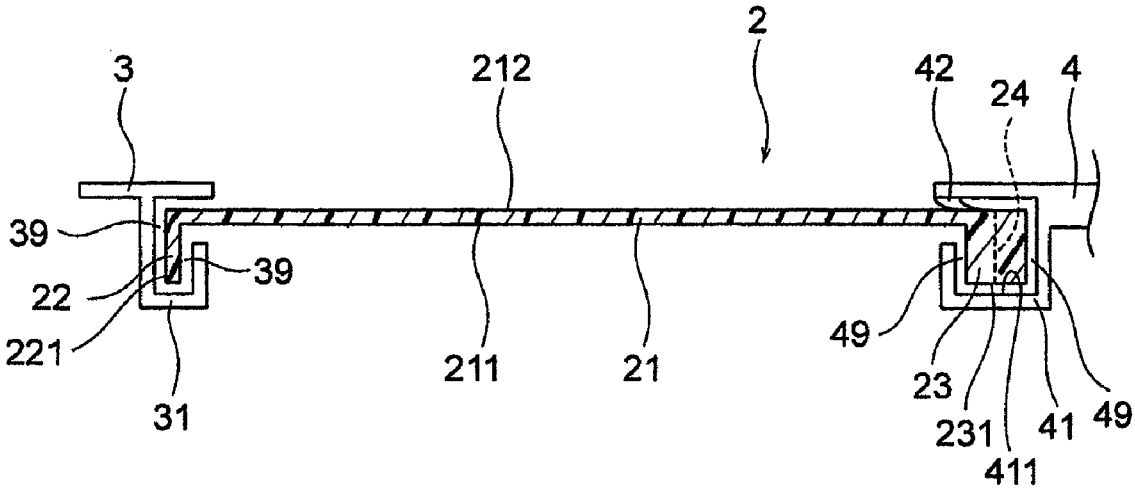
FIG. 3 is a sectional view along the lines A-A of FIG. 1.

As shown in FIG. 3, in the resin window 2, the other projection portion 22 is inserted into a frame portion 31 of the other-side guide frame 3, which is provided to surround a part of the outer side surface 221 of the other projection portion 22 and an outer surface 212 of the main body portion 21. A gap 39 is provided between the other projection portion 22 and the frame portion 31 of the other-side guide frame 3. In this embodiment, the gap 39 is formed on the front-side, rear-side, vehicle-interior-side and vehicle-exterior-side of the other projection portion 22.

Further, as shown in FIG. 3, the gear projection portion 23 is inserted into the frame portion 41 of the gear-side guide frame 4, which is provided to surround a part of the outer side surface 231 of the gear projection portion 23 and the outer surface 212 of the main body portion 21. Here, the side face (outer side surface 231) of the gear projection portion 23 is constituted by a front-side outer side surface 231*a*, a rear-side outer side surface 231*c*, a vehicle-interior-side outer side surface 231*b* and a vehicle-exterior-side outer side surface 231*d*. The resin window 2 is disposed along the front-rear direction of the vehicle while the gear projection portion 23 is formed to project toward the vehicle-interior-side, and therefore the frame portion 41 of the gear-side guide frame 4 is provided to surround the vehicle-front-side, vehicle-rear-side, and vehicle-exterior-side of the gear projection portion 23. A gap 49 is provided between the gear projection portion 23 and the frame portion 41. In this embodiment, the gap 49 is formed on the front-side, rear-side, vehicle-interior-side, and vehicle-exterior-side of the gear projection portion 23.

Figure 4:
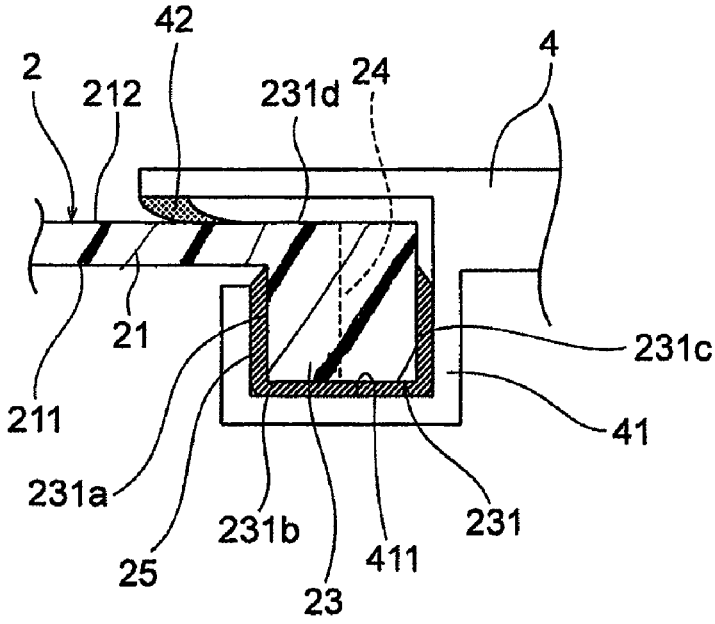
FIG. 4 is a sectional view along the lines B-B of FIG. 1.

As shown in FIG. 4, in the part of the gear projection portion 23 in which the positioning member 25 is provided, the positioning member 25 abuts on the inner side surface 411 of the frame portion 41.

Further, as shown in FIGS. 3 and 4, a lip member 42 is provided between the outer surface 212 of the main body portion 21 and the inner side surface 411 of the frame portion 41 to seal the two surfaces and prevent water infiltration and the like.

Figure 5:
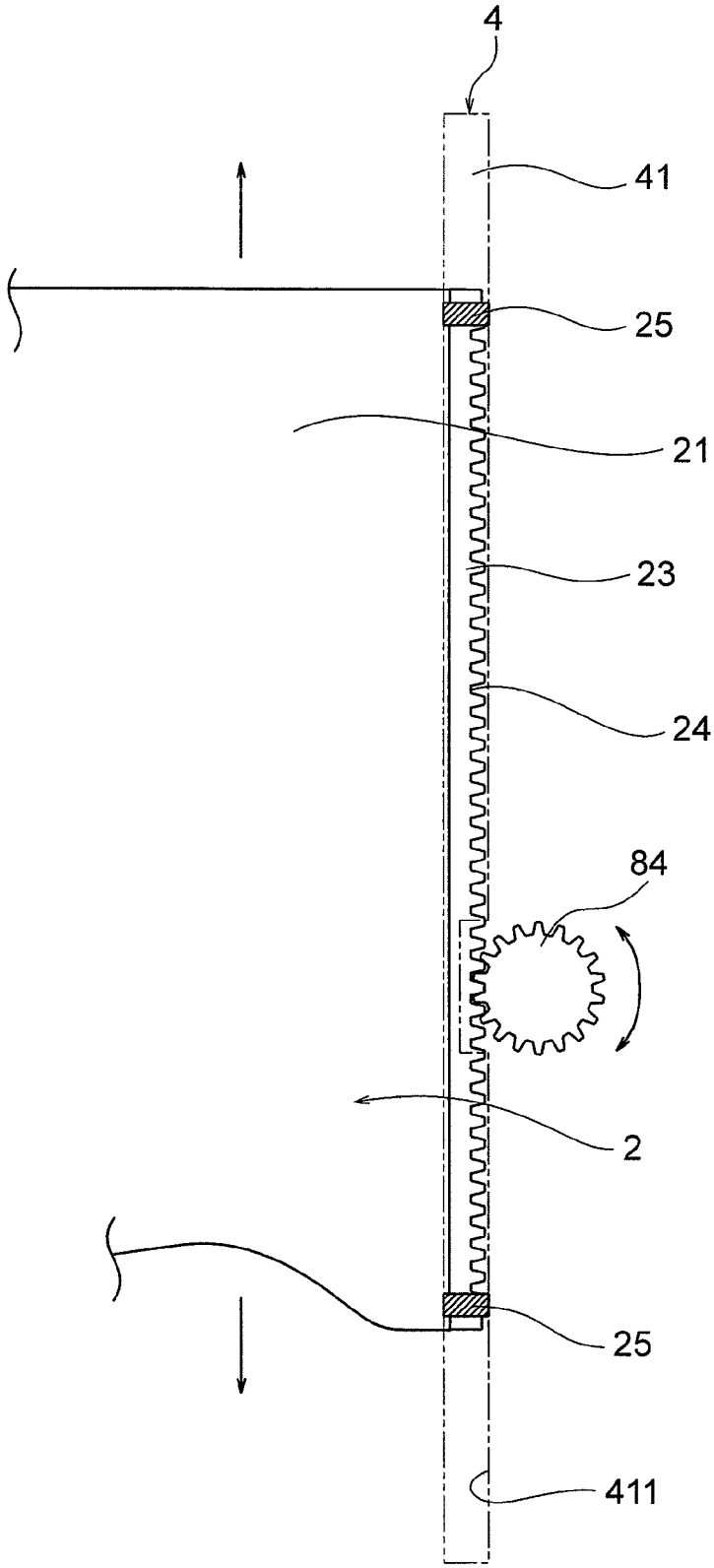
FIG. 5 is an illustrative view showing raising/lowering of the resin window according to the first embodiment.

As shown in FIG. 5, the resin window 2 can be raised and lowered in the vertical direction when the drive gear 84 is rotated relative to the meshing gear 24 of the gear projection portion 23 by the motor 83. More specifically, by causing the shoe member as the positioning member 25 of the gear projection portion 23 to slide relative to the inner side surface 411 of the frame portion 41 of the gear-side guide frame 4, the resin window 2 can be raised and lowered along the other-side guide frame 3 and the gear-side guide frame 4.

Next, actions and effects of the support structure 1 according to this embodiment will be described.

In this embodiment, as shown in FIG. 2, the resin window 2 includes the plate-shaped main body portion 21 and the gear projection portion 23 that projects in the thickness direction of the main body portion 21 from a rear end portion serving as one of the side end portions of the main body portion 21, and the main body portion 21 and gear projection portion 23 are integrally molded into the resin window 2. In other words, the gear projection portion 23 is provided on the main body portion 21 so that the resin window 2 is molded integrally, and as a result, the rigidity in the thickness direction (tension rigidity) of the resin window 2 can be increased.

Hence, even when the resin window 2 is made of a resin having lower rigidity than glass or the like, the required rigidity can be sufficiently secured. Therefore, bending of the resin window 2 or the like during raising and lowering can be suppressed, and the resin window 2 can be prevented from becoming dislodged from the other-side guide frame 3 and the gear-side guide frame 4 and so on. Moreover, the resin window 2 can be raised and lowered smoothly.

Further, as shown in FIG. 2, the moldability of resin is exploited to integrally form the main body portion 21 and the gear projection portion 23 on which the meshing gear 24 is provided in the resin window 2. In other words, the resin window 2 has an integral constitution rather than a constitution in which a member provided with a meshing gear is attached to a window, as in the related art.

Therefore, problems arising when separate members are provided with a window, for example joining defects, abrasion noise generated in a joint portion, effects caused by a difference in the coefficients of thermal expansion of different materials, and so on, can be eliminated. Moreover, the number of components can be reduced, thereby enabling structural simplification and reductions in cost and weight. Furthermore, the resin window 2 is less likely to break than a window made of glass or the like, and further the weight thereof can be reduced.

Moreover, as shown in FIGS. 4 and 5, the positioning members 25 that abut on the inner side surface 411 of the frame portion 41 of the gear-side guide frame 4 are provided respectively on the upper and lower end portions of the gear projection portion 23 of the resin window 2. Thus, the resin window 2 can be raised and lowered along the gear-side guide frame 4 while causing the positioning members 25 to slide relative to the inner side surface 411 of the frame portion 41 of the gear-side guide frame 4.

Hence, the position and attitude of the resin window 2 while being raised or lowered can be maintained by the positioning members 25 that slide while abutting on the inner side surface 411 of the frame portion 41 of the gear-side guide frame 4. As a result, tilting of the resin window 2 due to its own weight, raising/lowering resistance, an external load, and so on can be suppressed, thereby preventing accompanying raising/lowering problems. Accordingly, the resin window 2 can be raised and lowered smoothly and precisely.

Further, as shown in FIG. 5, the meshing gear 24 is provided on one side end portion (the rear end portion) of the resin window 2 such that the position and attitude of the resin window 2 during raising and lowering are maintained only by the one side on which the meshing gear 24 is provided. Here, the rigidity in the thickness direction (tension rigidity) of the resin window 2 is improved by molding the gear projection portion 23 integrally with the main body portion 21.

Hence, the position and attitude of the resin window 2 during raising and lowering can be sufficiently maintained even by the gear provided on only one side of the resin window 2, and therefore the effects described above can be obtained reliably. Furthermore, since the meshing gear 24 is provided on one side end portion (the rear end portion) of the resin window 2, structural simplicity can be achieved in comparison with a case in which meshing gears are provided on both sides, and in addition, deviation of mesh phases and accompanying problems such as raising/lowering defects do not occur.

Furthermore, in this embodiment, as shown in FIGS. 2, 4 and 5, the positioning members 25 are constituted by shoe members having a larger horizontal dimension than the parts of the gear projection portion 23 where the positioning members 25 are not provided. By employing shoe members as the positioning members 25, the position and attitude of the resin window 2 can be sufficiently maintained. Moreover, by making the horizontal dimensions of the positioning members 25 larger than the other parts of the gear projection portion 23 where the positioning members 25 are not provided, interference between the meshing gear 24 provided on the gear projection portion 23 and the gear-side guide frame 4 can be prevented. As a result, the resin window 2 can be raised and lowered even more precisely and smoothly.

Further, the positioning members 25 are formed integrally with the gear projection portion 23, enabling a reduction in the number of components and a reduction in cost.

Further, as shown in FIG. 3, the resin window 2 includes the other projection portion 22, which is provided in the other side end portion (the front end portion) of the main body portion 21, i.e. the side end portion in which the gear projection portion 23 is not provided, and is molded integrally with the main body portion 21 so as to project in the thickness direction of the main body portion 21. By providing the other projection portion 22, the rigidity of the resin window 2 can be increased even further. As a result, the effects of suppressing bending and the like in the resin window 2 during raising and lowering and preventing the resin window 2 from becoming dislodged from the gear-side guide frame 4 or the like can be exhibited even more favorably.

Further, as shown in FIG. 3, the outer side surface 221 of the other projection portion 22 is partially surrounded by the other-side guide frame 3 that guides the raising/lowering of the resin window 2, and the gap 39 is provided between the other projection portion 22 and the other-side guide frame 3. Hence, even when heat causes the resin window 2 to expand or contract, the other projection portion 22 and the other-side guide frame 3 do not interfere with each other due to the gap 39 secured therebetween. As a result, the resin window 2 can be raised and lowered smoothly at all times. Note that the size and position of the gap 39 can be set taking into account expansion and contraction of the resin window 2 due to heat.

Here, expansion and contraction due to heat is greater in the length direction of the resin window 2 than the thickness direction. Therefore, the gap 39 is preferably set taking into account expansion and contraction in the length direction of the resin window 2 in particular.

In this embodiment, the resin window 2 is disposed along the vehicle front-rear direction, and the gear projection portion 23 is formed to project toward the vehicle-interior-side. Therefore, the gap 39 is preferably formed on at least the vehicle-front-side and the vehicle-rear-side of the other projection portion 22. The gap 39 may of course be formed in other positions.

Hence, according to this embodiment, it is possible to provide the support structure 1 for a vehicular resin window with which the resin window 2 can be supported sufficiently and securely using a simple structure and the resin window 2 can be raised and lowered smoothly and precisely.

Note that in this embodiment, a shoe member is used as the positioning member 25, but a member such as a roller member having a roller rotating portion that slides relative to the inner side surface 411 of the frame portion 41 of the gear-side guide frame 4 while rotating may be used instead.

For example, when a roller member is used as the positioning member 25, the roller member preferably includes a roller rotating portion that projects further toward the gear-side guide frame 4 than the parts of the gear projection portion 23 where the positioning member 25 is not provided.

In this case, by employing a roller member as the positioning member 25, sliding properties relative to the inner side surface 411 of the frame portion 41 of the gear-side guide frame 4 can be improved. Further, by making the sliding roller rotating portion project further toward the gear-side guide frame 4 than the other parts, interference between the meshing gear 24 provided on the gear projection portion 23 and the gear-side guide frame 4 can be prevented. As a result, the resin window 2 can be raised and lowered smoothly and precisely.

Figure 6A:
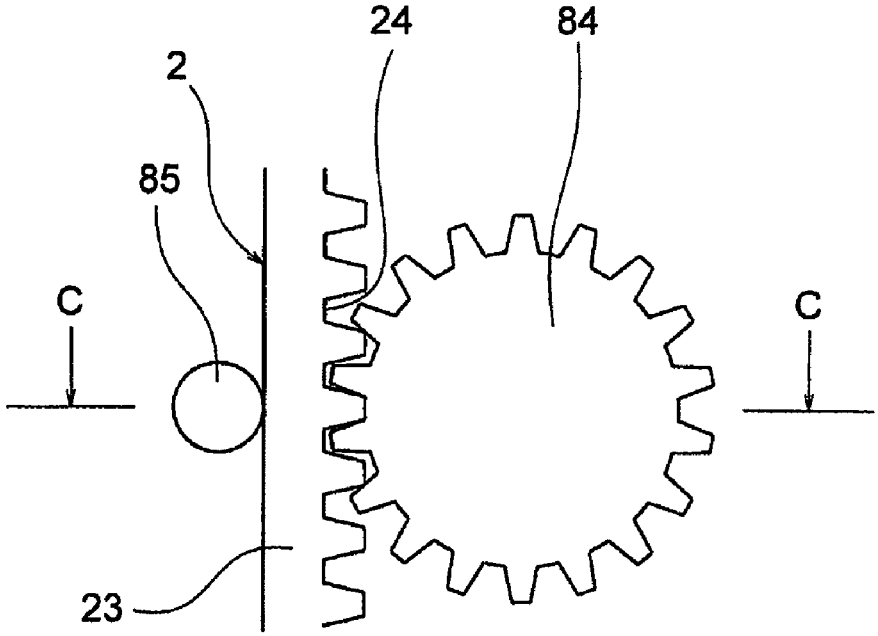
FIG. 6A is an illustrative view showing a disposal position of a support member according to the first embodiment.
Figure 6B:
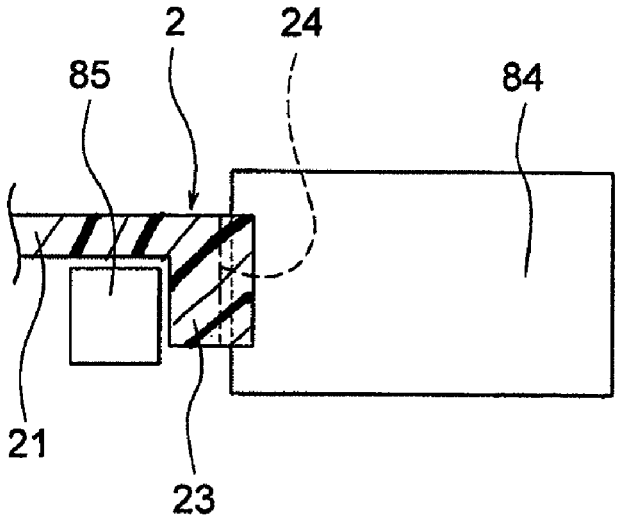
FIG. 6B is a sectional view along the lines C-C of FIG. 6A.

Further, as shown in FIGS. 6A and 6B, the gear projection portion 23 may be sandwiched between the drive gear 84 that meshes with the meshing gear 24 and a support member 85 provided opposite the drive gear 84. In this case, for example, the drive gear 84 and support member 85 can be provided on a bracket, not shown in the drawings, to secure a distance between the two components in the horizontal direction. Therefore, since the horizontal direction distance between the drive gear 84 and the meshing gear 24 can be secured, intermeshing of the drive gear 84 and meshing gear 24 can be stabilized. As a result, the position and attitude of the resin window 2 can be maintained more sufficiently, whereby the resin window 2 can be raised and lowered even more smoothly.

Further, a typical shoe member or roller member may be employed as the support member 85. In this case, the support member 85 preferably exhibits a favorable sliding property relative to the gear projection portion 23. Further, the support member 85 may be provided singly or plurally.

Figure 7:
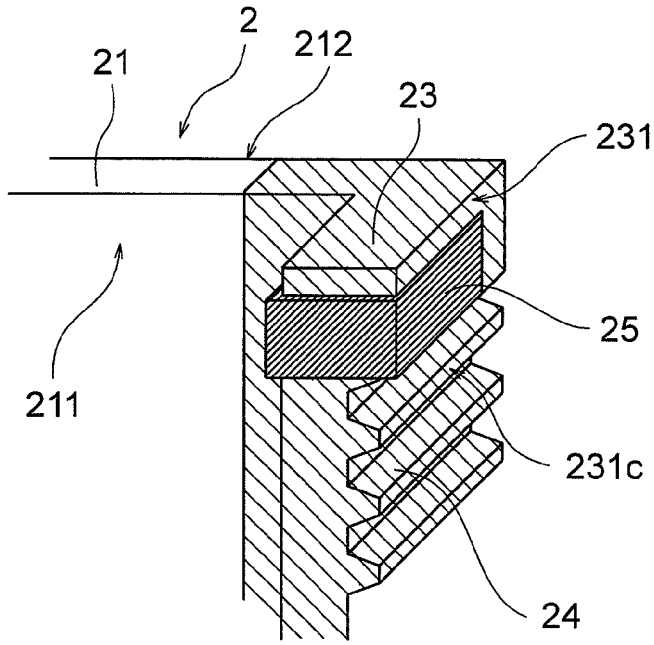
FIG. 7 is an illustrative view showing an example of a two-color molded resin window according to the first embodiment.

Further, as shown in FIG. 7, the resin window 2 may be a two-color molding using two different types of resin.

For example, a polycarbonate resin, which is a transparent resin having no additives, may be used in parts requiring transparency such as the main body portion 21, and a polycarbonate resin having an added reinforcing material such as glass fiber (GF) or carbon fiber (CF), or a polycarbonate resin having an added material that exhibits great chemical resistance, such as polyethylene terephthalate (PET) resin, acrylonitrile butadiene styrene (ABS) resin, may be used in shaded parts such as the gear projection portion 23, which require strength but not transparency. The resin window 2 may then be formed by subjecting these materials to two-color molding.

In so doing, the gear projection portion 23, which requires strength, can be strengthened efficiently. Further, a reduction in the size of the gear projection portion 23 can be achieved while maintaining the strength of the gear projection portion 23. Moreover, by reducing the size of the gear projection portion 23, a reduction in the size of the gear-side guide frame 4 surrounding the gear projection portion 23 can be achieved.

Second Embodiment

In this embodiment, the constitution of the gear projection portion 23 of the resin window 2 is modified.

Figure 8:
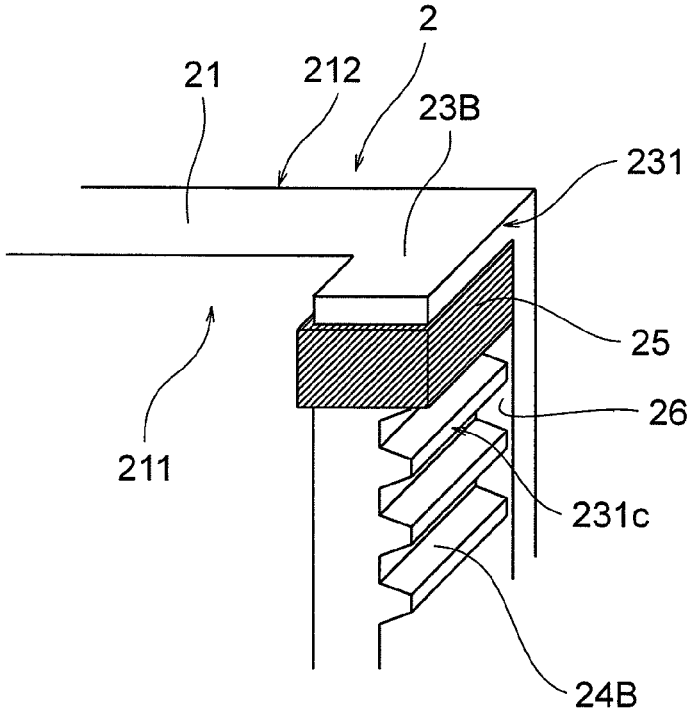
FIG. 8 is an illustrative view showing an example of a gear projection portion provided with a wall portion according to a second embodiment.
Figure 9:
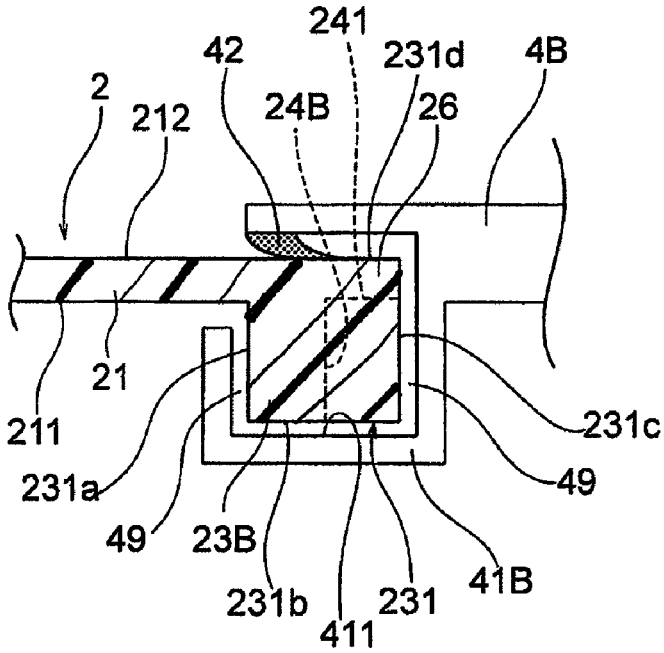
FIG. 9 is a partial plan view showing a relationship between the gear projection portion according to the second embodiment and a gear-side guide frame.

In this embodiment, as shown in FIGS. 8 and 9, a meshing gear 24B is provided on a side face of a gear projection portion 23B located on a side-end side of the resin window 2, or in other words the rear-side outer side surface 231*c* of the gear projection portion 23B. Further, the resin window 2 is provided with a wall portion 26 that is molded integrally with the meshing gear 24B so as to cover a vehicle-exterior-side outer side surface 241 of the meshing gear 24B, which opposes a projecting side (vehicle-interior-side) of the gear projection portion 23B.

All other constructions are identical to their counterparts in the first embodiment.

By providing the wall portion 26 according to this embodiment, the strength of the meshing gear 24B part of the gear projection portion 23B in particular can be increased. Further, a reduction in the size of the meshing gear 24B can be achieved while maintaining the strength of the meshing gear 24B part. Moreover, by reducing the size of the meshing gear 24B, a reduction in the size of a gear-side guide frame 4B surrounding the gear projection portion 23B can be achieved.

Furthermore, by providing the wall portion 26, the meshing gear 24B is not exposed on the vehicle-exterior-side outer side surface 241 of the meshing gear 24B. When the lip member 42 is provided between the resin window 2 and the frame portion of the gear-side guide frame to seal the two components and prevent water infiltration and the like, the part in which the meshing gear is exposed cannot normally be used as a sealing surface. However, by covering the vehicle-exterior-side outer side surface 241, which is one of the side faces of the meshing gear 24B, with the wall portion 26, the wall portion 26 can be used as a sealing surface of the lip member 42. Therefore, as shown in FIG. 9, the disposal position of the lip member 42 can be shifted further toward the inside of the frame portion 41B than in the first embodiment shown in FIGS. 3 and 4, in which the meshing gear 24 is exposed. Moreover, a further reduction in the size of the gear-side guide frame 4B can be achieved.

Additionally, similar actions and effects to those of the first embodiment can be obtained.

Third Embodiment

In this embodiment, the constitution of the gear projection portion 23 of the resin window 2 is modified.

Figure 10:
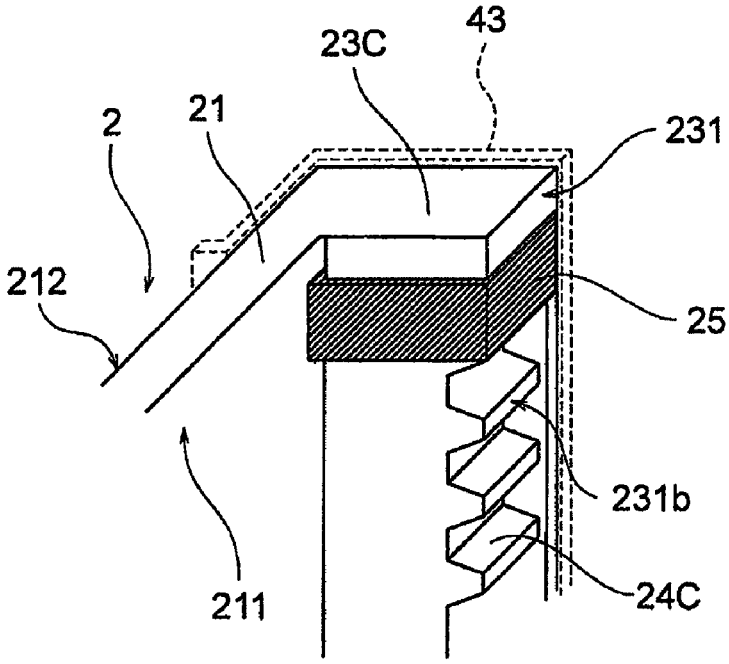
FIG. 10 is an illustrative view showing an example of a gear projection portion in which a meshing gear is provided on a vehicle-interior-side outer side surface of the gear projection portion according to a third embodiment.
Figure 11:
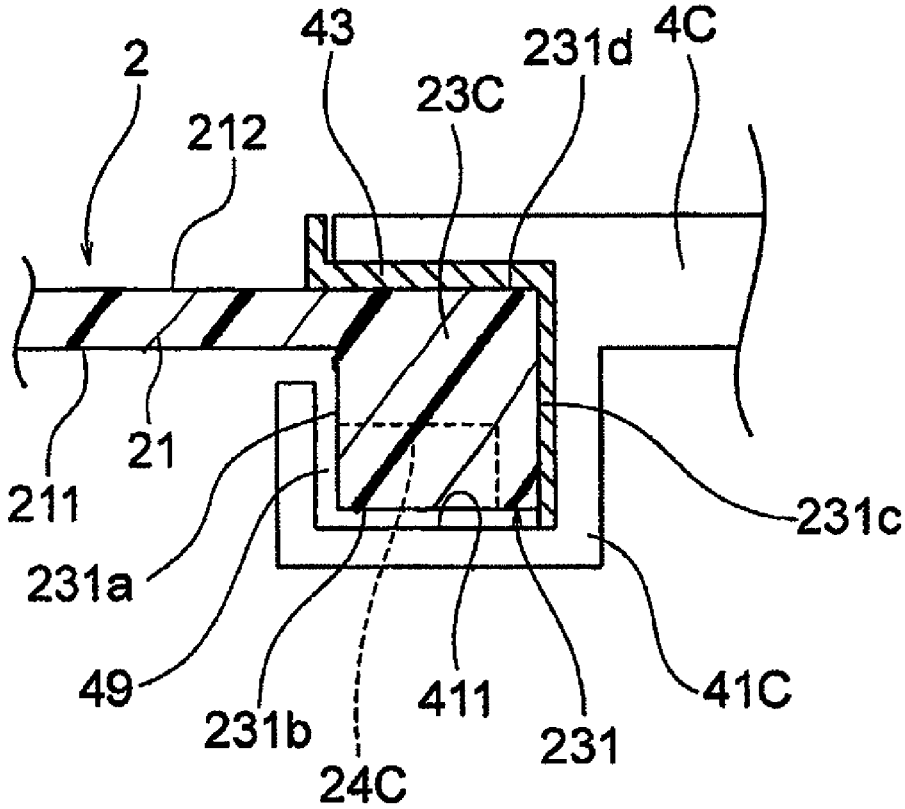
FIG. 11 is a partial plan view showing a relationship between the gear projection portion according to the third embodiment and a gear-side guide frame.

In this embodiment, as shown in FIGS. 10 and 11, a meshing gear 24C is provided on a side face of the projecting side of a gear projection portion 23C, or in other words the vehicle-interior-side outer side surface 231*b* of the gear projection portion 23C. The meshing gear 24C is disposed so as not to be exposed to the rear-side outer side surface 231*c* of the gear projection portion 23C. Further, the positioning member 25 is provided on the front-side outer side surface 231*a* and the vehicle-interior-side outer side surface 231*b* of the gear projection portion 23C.

Further, as shown in FIGS. 10 and 11, a glass run 43 for guiding raising/lowering of the resin window 2 is provided on the inner side surface 411 of a frame portion 41C of a gear-side guide frame 4C. The glass run 43 is provided to cover the rear-side outer side surface 231*c* and the vehicle-exterior-side outer side surface 231*d* of the gear projection portion 23C.

All other constructions are identical to their counterparts in the first embodiment.

According to this embodiment, although not shown in the drawings, the drive gear 84 that meshes with the meshing gear 24C, the motor 83 that rotates the drive gear 84, and so on may be disposed on the projecting side of the gear projection portion 23C, or in other words the vehicle-interior-side, which is one of the sides of the resin window 2 in the thickness direction, for example. Hence, in comparison with the constitution of the first embodiment, shown in FIG. 1, the size of the resin window 2 in the length direction (i.e. the compactness of the resin window 2) can be reduced.

Further, the positioning member 25 may be caused to slide relative to the inside surface of the gear-side guide frame 4C, or in other words the inner side surface 411 of the frame portion 41C or the glass run 43 disposed on the inner side surface 411 of the frame portion 41C. Thus, the effects of supporting the resin window 2 sufficiently and securely using a simple structure and raising/lowering the resin window 2 smoothly and precisely are sufficiently obtained. Furthermore, by providing the glass run 43, the resin window 2 can be sealed from the gear-side guide frame 4C.

Note that the glass run 43 may be provided on the inside surface of the other-side guide frame 3. In so doing, the resin window 2 can be sealed from the other-side guide frame 3.

Additionally, similar actions and effects to those of the first embodiment can be obtained.

Note that in this application, the inside surface of the gear-side guide frame is a concept encompassing not only the inner side surface 411 of the frame portion 41, 41B, 41C of the gear-side guide frame 4, 4B, 4C according to the first to third embodiments, but also a surface of the glass run 43 provided on the inner side surface 411 of the frame portion 41C of the gear-side guide frame 4C and so on.

In the first to third embodiments, the resin window 2 is disposed along the vehicle front-rear direction, the gear projection portion 23, 23B, 23C is formed to project toward the vehicle-interior-side, and the gear-side guide frame 4, 4B, 4C is provided to surround the vehicle-front-side, vehicle-rear-side, and vehicle-exterior-side of the gear projection portion 23, 23B, 23C. However, the gear-side guide frame 4, 4B, 4C may of course be constituted differently.

Furthermore, in the first to third embodiments, the outer peripheral surface of the shoe member employed as the positioning member 25 may be curved (rounded). In this case, the part of the shoe member that abuts on the inside surface of the gear-side guide frame 4, 4B, 4C can be secured by making the outer peripheral surface of the shoe member curved, and therefore the sliding property of the shoe member can be maintained even when the contact between the shoe member and the gear-side guide frame 4, 4B, 4C is insufficient and vibrations or the like are generated in the resin window 2. As a result, the resin window 2 can be raised and lowered smoothly.

What is claimed is:

1. A support structure configured to support a resin window of a vehicle so that the resin window can be raised and lowered, the support structure comprising:

the resin window including a plate-shaped main body portion and a gear projection portion that is molded integrally with the main body portion so as to project in a thickness direction of the main body portion from one side end portion of the main body portion; and a gear-side guide frame for guiding a raising and a lowering of the resin window, the gear-side guide frame surrounding at least a part of a side face of the gear projection portion, wherein the gear projection portion includes a meshing gear provided along a vertical direction to mesh with a drive gear that can be rotated by a rotator, and positioning members provided respectively on at least upper and lower end portions of the gear projection portion to abut on an inside surface of the gear-side guide frame, wherein the gear projection portion is disposed between the drive gear that meshes with the meshing gear and a support member provided opposite the drive gear, and wherein when the drive gear is rotated by the rotator, the positioning members slide relative to the inside surface of the gear-side guide frame such that the resin window is raised and lowered along the gear-side guide frame.

2. The support structure according to claim 1, wherein the positioning members are constituted by shoe members having a larger horizontal dimension than a part of the gear projection portion in which the positioning members are not provided.

3. The support structure according to claim 1, wherein the positioning members are constituted by roller members having a roller rotating portion that projects further toward the gear-side guide frame side than a part of the gear projection portion in which the positioning members are not provided, and the roller members slide relative to the inside surface of the gear-side guide frame while the roller rotating portion rotates.

4. The support structure according to claim 1, wherein a glass run for guiding the raising and the lowering of the resin window is provided on at least a part of the inside surface of the gear-side guide frame.

5. The support structure according to claim 1, wherein the resin window comprises another projection portion molded integrally with the main body portion so as to project in the thickness direction of the main body portion from another side end portion of the main body portion in which the gear projection portion is not provided.

6. The support structure according to claim 5, wherein at least a part of a side face of the other projection portion is surrounded by an other-side guide frame for guiding the raising and the lowering of the resin window, and a gap is provided between the other projection portion and the other-side guide frame.

7. The support structure according to claim 1, wherein the meshing gear is provided on a side face of the gear projection portion located on a side-end side of the resin window, and the resin window is provided with a wall portion that is molded integrally with the meshing gear so as to cover a side face of the meshing gear that opposes a projecting side of the gear projection portion.

8. The support structure according to claim 1, wherein the meshing gear is provided on a side face of the gear projection portion located on a projecting side of the gear projection portion.

* * * * *